United States Patent [19]

Oehler

[11] Patent Number: 5,016,558

[45] Date of Patent: May 21, 1991

[54] BOAT WITH RETRACTABLE ROOF

[76] Inventor: William P. Oehler, 8430 E. Cresco La., Inverness, Fla. 32650

[21] Appl. No.: 538,434

[22] Filed: Jun. 15, 1990

[51] Int. Cl.[5] ..... B63B 17/00

[52] U.S. Cl. ..... 114/361; 135/88

[58] Field of Search ..... 114/343, 361; 135/88, 135/102, 117, 904

[56] References Cited

U.S. PATENT DOCUMENTS

| | | | |
|---|---|---|---|
| 245,651 | 8/1881 | Meech | 114/361 |
| 2,280,729 | 4/1942 | Sutton | 114/361 |
| 3,312,990 | 4/1967 | Lapworth | 114/361 |
| 3,805,724 | 4/1974 | Butler | 114/361 |

*Primary Examiner*—Jesûs D. Sotelo

*Attorney, Agent, or Firm*—Rockey & Rifkin

[57] ABSTRACT

A boat has a top retractable from a normal, relative high position, to a retracted relatively low position via a plurality of supports arranged as parallel linkages. The boat carries an upright structure that normally projects above the level of the retracted roof and that would form an obstacle to passage of the boat under low bridges, for example. The upright structure may be a head or galley having a hinged upper part that retracts along with the retracting roof, thus diminishing the height of the structure to about the level of the retracted roof.

11 Claims, 3 Drawing Sheets

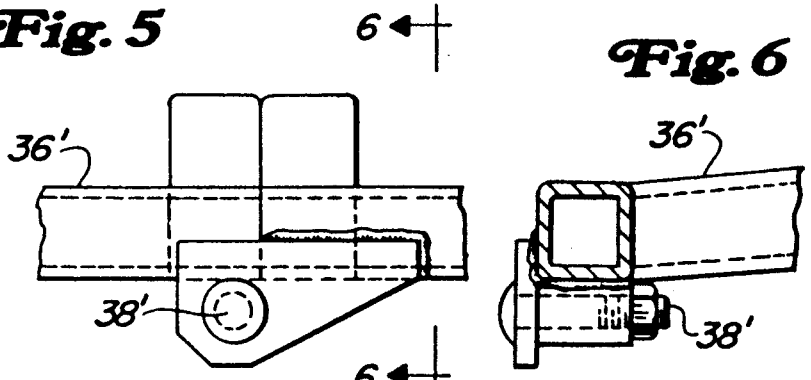
Fig. 5
Fig. 6
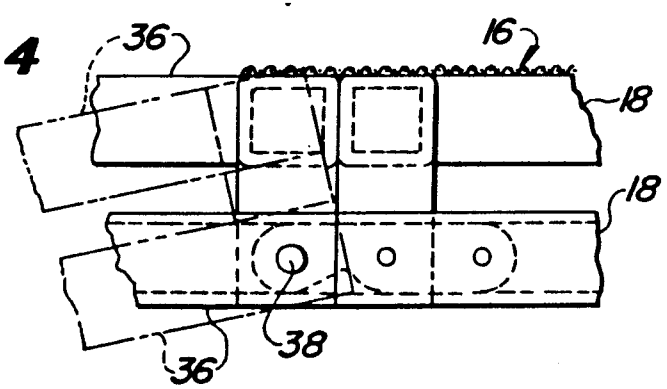
Fig. 4
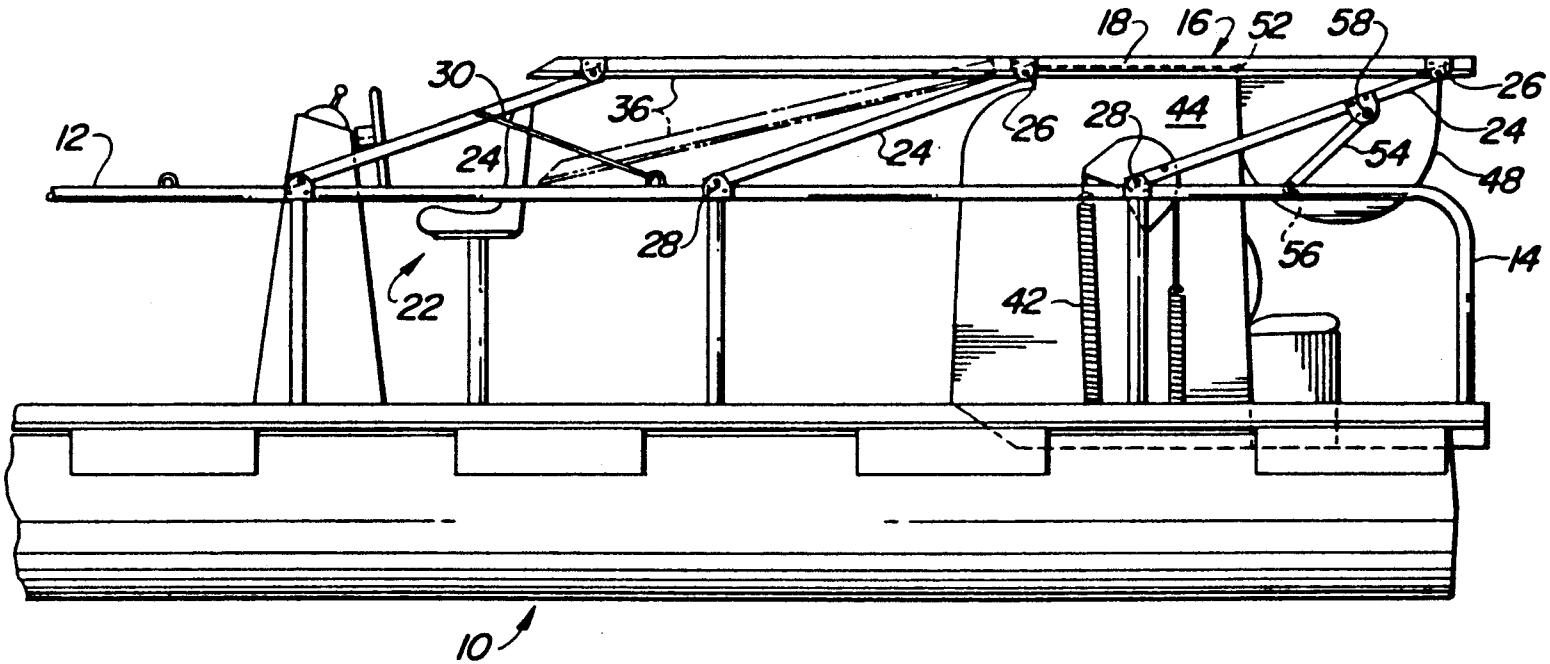
Fig. 3

BOAT WITH RETRACTABLE ROOF

BACKGROUND AND SUMMARY OF THE INVENTION

It is known of course to provide folding or retractable roofs for boats as well as for other vehicles The problem is more acute in boats, especially in certain recreational areas, because of the frequency with which low bridges are encountered. Consequently, the retracting structure must be convenient to operate. In addition to this, most boats, particularly those of the catamaran type, will include one or more upright structures; e.g., heads, galleys and the like, which normally rise to heights at about the level of the roof in its normal or operating mode. Thus, retracting of the roof alone is not enough to solve the low bridge problem, because of the stand-up head or galley. Hence, the basic feature of the present invention is to provide the upright structure of two-piece construction, including a base part carried by the boat and rising to an upper portion at about the level of the retracted roof and a top part hinged to the base part and so connected to the roof supports that the top structure retracts in unison with the roof and all basic high-level elements become low-level elements Further objects are to provide a simple design that may be provided as original equipment or added to existing boats and one that may be conveniently operated by the boat owner. Features and advantages other than those pointed out will appear as the disclosure of the invention proceeds.

DESCRIPTION OF THE DRAWINGS

FIG. 3 is a partial side elevation showing the roof and galley top retracted, further illustrating in broken lines a separately down-folded portion of the roof.

FIG. 4 is an enlarged view, with portions omitted, of one form of means for connecting the front roof part to the rest of the roof.

FIG. 5. is a modified form of the structure shown in FIG. 4.

FIG. 6 is a view of the FIG. 5 structure as seen along the line 6—6 on FIG. 5.

DETAILED DESCRIPTION OF A PREFERRED EMBODIMENT OF THE INVENTION

Figure 1:
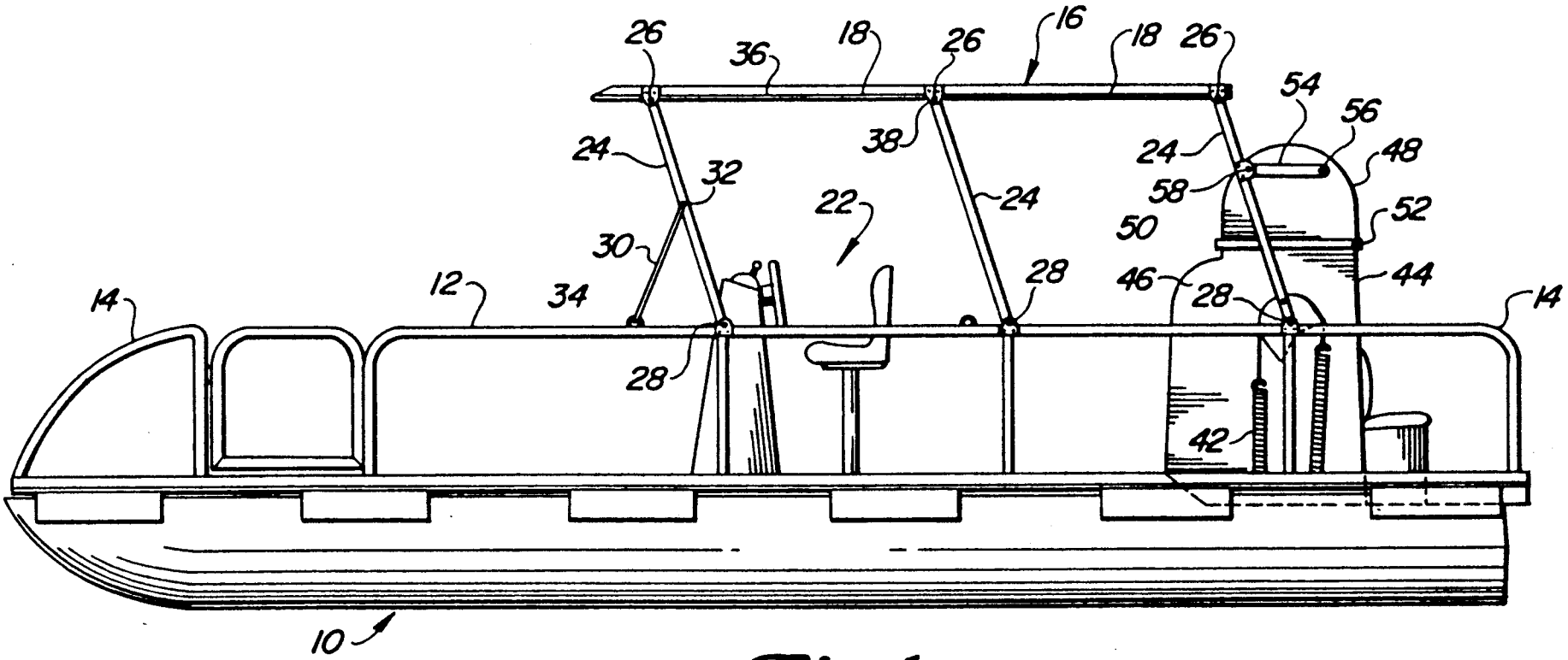
FIG. 1 is a side elevation of a representative structure utilizing the invention.

The boat chosen for the purposes of disclosure is typical of the well-known catamaran type; although, the invention is not limited to that type of vessel. The boat has a main body part 10 provided with longitudinal, fore-and-aft opposite sides, here in the form of rails 12, supplemented by front and rear end rails 14. A generally horizontal roof 16 overlies the body from side to side and front to rear and is operatively disposed at a normal level or position as depicted in FIG. 1, the height being such that adult passengers may conveniently move about the deck. The roof is here shown as being made up of a plurality of rigid, light-weight frame bars 18 carrying a top or cover 20 of any suitable material The normal level of the roof may be seen from its relationship to a typical control station 22.

Figure 2:
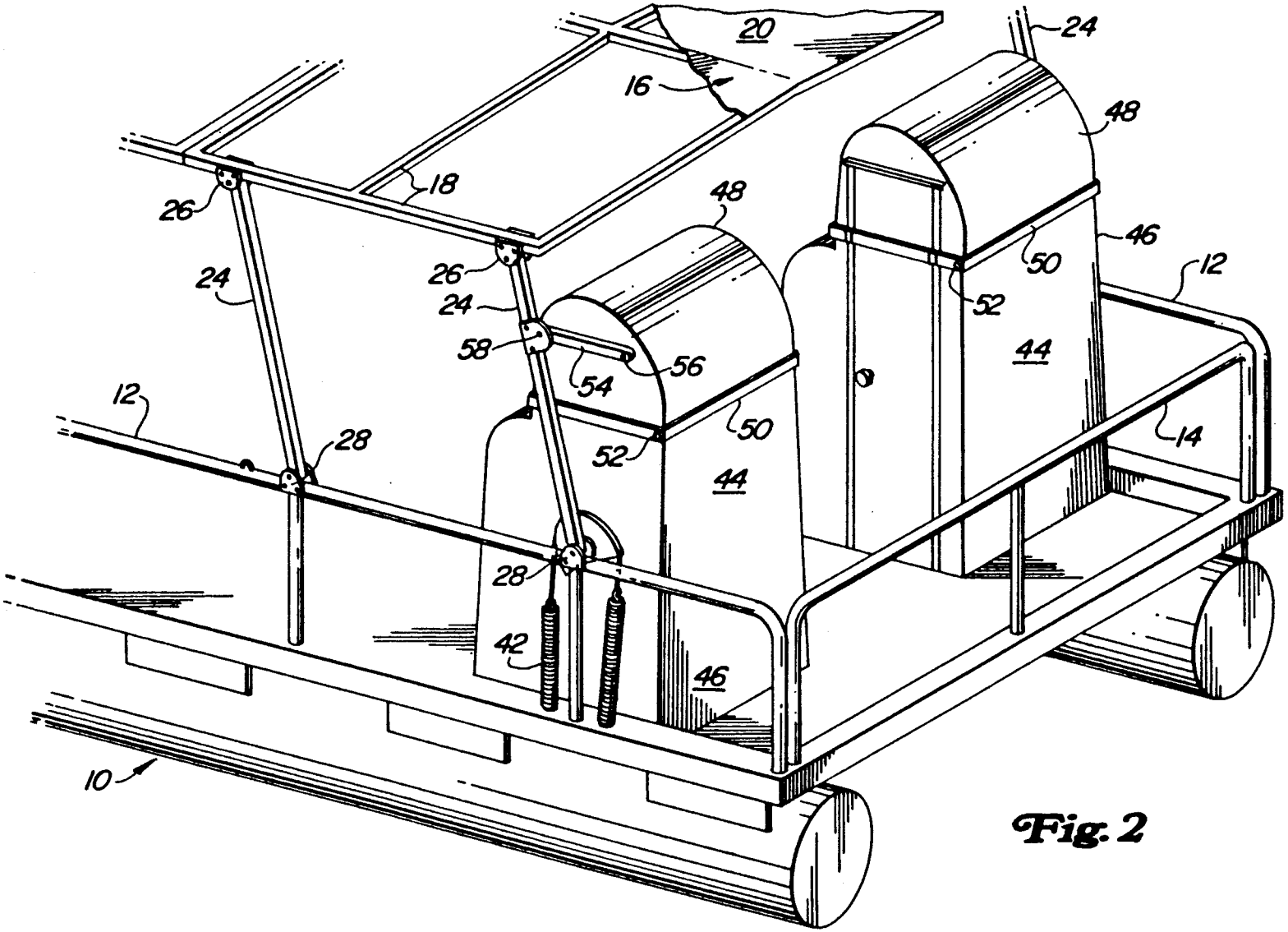
FIG. 2 is an enlarged fragmentary perspective further showing the elements of the invention.

The roof is normally carried at its high level by a plurality of rigid, generally upright supports 24, each pivoted at 26 at its upper end to the roof on a horizontal, transverse axis, and at its lower end is pivoted at 28 to the proximate side rail 12. The normal or generally upright positions of the supports are maintained by selectively releasable means, here comprising opposite side braces 30, each connected at 32 to a front support 24 and releasably connected at 34 to a proximate side rail 12. As seen in FIG. 2, when the braces 30 at both sides of the body are released, the parallel linkage arrangements enables rearward and downward folding or retraction of the roof to a lower level, determined on the basis of general knowledge of bridges to be encountered.

When the roof is folded or retracted, a further feature is available. As shown in broken lines in FIGS. 2 and 4, a forward section 36 of the roof, pivoted at 38 on a transverse axis to the rest of the roof, is swingable downwardly to overlie the deck just to the rear of the control station 22, serving generally as a cover during mooring of the vessel, for example, and also for reducing wind resistance when the vessel is trailered for highway transport. For this purpose, the front supports 24 at both sides of the body part will be disconnected at one end or the other. A suitable lap joint is provided to seal the two roof elements in the extended or up position of the roof element 38. FIGS. 5 and 6 show another form of connection of a forward roof part or element 36' mounted on a transverse pivot 38, for achieving the down-folding feature just described.

To facilitate up and down movement of the roof, assist or counter-balance means 42 is provided at both sides of the body part, interconnected between the body part and the rear supports 24.

The boat carries at its rear a pair of upright structures or compartments 44, one of which may be a head and the other a galley. For the purposes of the present disclosure these structures may be regarded as similar if not identical. Each is of a height accommodating a standing adult and is made up of a base element 46 and a top element 48. The base element is fixed to the body and rises to an upper portion 50 at a level well below the normal level of the roof part, and the associated top element 48 is an upward extension above the portion 50 but above the level of the roof in the retracted position of the roof. Thus, without more, the top element would be too high and also would interfere with rearward and downward retraction of the roof. The problem, however, is solved by hinging each top element to the upper portion of its base element on a transverse axis 52 at the rear of the junction between each base element and its top element. This enables rearward and downward swinging of the top elements to the positions of FIG. 2, wherein it is seen that each top element is inverted and extends rearwardly of its base element rather than upwardly as when normally disposed.

A connection, including a link 54, pivoted at 56 to each top element and at 56 to the proximate or rear support 24, functions to move the top element in conjunction with or in response to movement of the roof; that is, when the roof is at its normal or higher level, each top element of the structure 44 is at its normal or high level, and, when the roof is lowered or retracted, the top elements are likewise lowered or retracted and thus not only removed from possible interference with the retracting roof but also low enough to escape low bridges, which when passed, enables the roof and top elements 48 to be restored to normal positions. Further, the links 54 may be disconnected so that one or both of the top elements can be separately inverted while the roof is up, thus enabling either inverted element to serve as a receptacle; e.g., for a barbecue grill or the like. Moreover, with both the brace 30 and link 54 disconnected the roof may be folded forwardly to lie flatwise over the deck in an alternate low-level position.

It is seen from the foregoing that a simple structure has been provided for effecting retraction and extension of not only the roof but of the upwardly projecting parts of the structures 44. Manipulation of the components to achieve normal and retracted positions is easily achieved Features and advantages not specifically pointed out will occur to those versed in the art, will many modifications in the preferred embodiment disclosed, all without departure from the spirit and scope of the invention.

I claim:

1. A boat having a body part including longitudinal fore-and-aft sides spaced transversely of the length of the body part, a fore-and-aft roof part overlying the body part and disposed in a normal position spaced above the body part sides, a plurality of normally generally upright supports pivoted at their upper and lower ends respectively to the body part sides and to the roof part on the transverse axis and swingable downwardly and lengthwise of the body part in one direction to retract the roof part to a low-level position, releasable means selectively operative between the supports and one of said parts to retain the supports generally upright or to release the uprights for retraction of the roof part, upright structure carried by the body part intermediate the sides and ends of the body part and including a base element rising to an upper portion at about the level of the retracted roof part and further including a top element disposed in a normal position as an upward extension of the base element to a higher level above the level of the retracted roof part, means connecting the top element to the base element for selective movement of the top element between its normal position and a retracted lower position at about the level of the retracted roof part, and means connected between at least one support and the top element for moving the top element between its normal and retracted positions in response, respectively, to movement of the roof part between its normal and retracted positions.

2. A boat according to claim including biased assist means connected between at least one of the supports and the body part and operative in over-center fashion to facilitate movement of the roof between normal and covered positions.

3. A boat according to claim 1, in which the releasable means is a releasable brace arranged normally in triangular fashion between at least one of the supports and the body part.

4. A boat according to claim 1, in which the supports are arranged as parallel linkages.

5. A boat according to claim 1, in which the means connected between the support and the top element includes a link having front and rear ends respectively pivoted to the support and top element on transverse axis.

6. A boat according to claim 1, in which the roof part includes front and rear elements interconnected on a transverse axis for downward swinging of one roof element relative to the other in addition to retractable lowering of the roof part relative to the body.

7. A boat according to claim 6, in which the supports include front, intermediate and rear elements, the interconnection of the roof elements occurs at about the intermediate support, and disconnection of the front support enables downward swinging of the front roof element.

8. A boat according to claim 1, in which the upright structure is a compartment and the top element is a cover therefor.

9. A boat according to claim 8, in which movement of the top element to its retracted position effects inversion of said top element.

10. A boat according to claim 1, in which the means connected between a support and a top element is disconnectible so as to enable movement at the top element independently of the roof.

11. A boat according to claim 10, in which the disconnection of the means between a support and a top element enables swinging of the supports lengthwise of the body in the opposite direction for retraction of the roof part in said opposite direction to an alternative low-level position.

* * * * *